US005529891A

United States Patent [19]

Wang et al.

[11] Patent Number: 5,529,891

[45] Date of Patent: Jun. 25, 1996

[54] PHOTOGRAPHIC ELEMENT HAVING IMPROVED SCRATCH RESISTANCE

[75] Inventors: Yongcai Wang, Penfield; Alfred B. Fant, Rochester; Kurt M. Schroeder, Rochester; Gary W. Visconte, Rochester, all of N.Y.

[73] Assignee: Eastman Kodak Company, Rochester, N.Y.

[21] Appl. No.: 440,263

[22] Filed: May 12, 1995

[51] Int. Cl.[6] ..... G03C 1/38; G03C 1/32

[52] U.S. Cl. ..... 430/523; 430/533; 430/537; 430/631; 430/961

[58] Field of Search ..... 430/523, 631, 430/961, 533, 537

[56] References Cited

U.S. PATENT DOCUMENTS

| | | |
|---|---|---|
| 2,454,043 | 11/1948 | Dimsdale et al. . |
| 2,588,765 | 3/1952 | Robijns et al. . |
| 2,732,305 | 1/1956 | Richman et al. . |
| 2,976,148 | 3/1961 | Walford et al. . |
| 3,042,222 | 7/1962 | Lehmann . |
| 3,042,522 | 7/1962 | Ben-Ezra et al. . |
| 3,053,662 | 9/1962 | Mackey et al. . |
| 3,080,317 | 3/1963 | Tallet et al. . |
| 3,121,060 | 2/1964 | Duane et al. . |
| 3,206,311 | 9/1965 | Campbell et al. . |
| 3,295,979 | 1/1967 | Secrist et al. . |
| 3,489,567 | 1/1970 | McGraw et al. . |
| 3,502,473 | 3/1970 | Snellman et al. . |
| 3,933,516 | 1/1976 | Mackey . |
| 4,004,927 | 1/1977 | Yamamoto et al. . |
| 4,047,958 | 9/1977 | Yoneyama et al. . |
| 4,268,623 | 5/1981 | Sera et al. . |
| 4,427,964 | 1/1984 | Ruegsegger . |
| 4,777,113 | 10/1988 | Inoue et al. . |
| 4,820,615 | 4/1989 | Vandenabeele et al. ..... 430/531 |
| 4,914,012 | 4/1990 | Kawai . |

FOREIGN PATENT DOCUMENTS

| | | |
|---|---|---|
| 955061 | 4/1964 | United Kingdom . |
| 1065536 | 4/1967 | United Kingdom . |
| 1143118 | 2/1969 | United Kingdom . |
| 1198387 | 7/1970 | United Kingdom . |
| 1263722 | 2/1972 | United Kingdom . |
| 1270578 | 4/1972 | United Kingdom . |
| 1320565 | 6/1973 | United Kingdom . |
| 1320756 | 6/1973 | United Kingdom . |
| 1320757 | 6/1973 | United Kingdom . |
| 1430997 | 4/1976 | United Kingdom . |
| 1466304 | 3/1977 | United Kingdom . |

OTHER PUBLICATIONS

Research Disclosure No. 308, Dec. 1989, p. 1006.

*Primary Examiner*—Thorl Chea
*Attorney, Agent, or Firm*—Robert A. Gerlach

[57] ABSTRACT

An imaging element having a support, at least one light-sensitive layer and a protective layer containing a binder and lubricating particles, said lubricating particles having a volume of at least 0.085 $\pi t^3$ where t is the dry thickness of the protective layer.

16 Claims, No Drawings

PHOTOGRAPHIC ELEMENT HAVING IMPROVED SCRATCH RESISTANCE

BACKGROUND OF THE INVENTION

FIELD OF THE INVENTION

This invention relates to an imaging element and in particular to a photographic element with greatly improved surface scratch and abrasion resistance.

During the handling of photographic elements, such as coating, drying, finishing, winding, rewinding, printing, and so on, the material surfaces are often harmed by contact friction with apparatus parts and between the front and back surfaces of the element. For example, scratches or abrasion marks can be brought about on the emulsion and backsides of a photographic material. These scratches and abrasion marks can deface the image during printing and projecting processes. On irreplacable negatives, the physical scratches or surface damages require very expensive retouching.

Heretofore, there have been various proposals to obtain a physically improved photographic material by increasing the abrasion and scratch resistance of the overcoat layer, or by reducing the contact friction of the photographic material to other surfaces so that it will not be damaged during the manufacturing, exposure, developing, and printing or projecting processes. For example, methods for improving the scratch resistance include adding a certain class of hardener to gelatin; using colloidal silica in the overcoat layer either alone or in combination with a water soluble polymer having a carboxylic acid group; using two overcoat layers, the upper layer containing a colloidal silica and the lower layer containing a polymer latex; and using a composite latex comprising a polymeric acrylic acid ester and/or a polymeric methacrylate acid ester and colloidal silica. Methods for reducing the contact friction include incorporating both a silicone fluid and a surface active agent into the protective overcoat; using a mixture of dimethyl silicone and diphenyl silicone on the backside of the support; incorporating a triphenyl terminated methyl phenyl silicone into the emulsion protective overcoat; using a combination of dimethyl silicone and beta-alanine derived surfactants; using modified sperm oils in the protective overcoat; using liquid organopolysiloxane with methyl and alkyl or aryl, or aralkyl side groups in the protective overcoat; and by using polysiloxane with polyether side chains on the backside of the support.

In recent years, the conditions under which photographic materials are manufactured and utilized have become more severe. This is either because applications of photographic elements have been extended to more harsh conditions such as high humidity and high temperature or because preparation methods have been advanced, including high speed coating, high speed finishing and cutting, and faster processing. Further, the emulsion layers have been progressively thinned. Under these conditions, photographic elements, materials are more severely scratched and the above-mentioned methods have to be modified, or improved, or optimized for best protection.

As a result, there is a need to provide photographic elements having improved resistance against abrasion and scratches.

SUMMARY OF THE INVENTION

The present invention provides an imaging element comprising a support, at least one light-sensitive layer, and a protective layer containing a binder and lubricant particles, with the said lubricant particles having a mean volume equal or larger than $0.085\ \pi t^3$, where t is the dry thickness of the protective layer.

The protective layer may be positioned in any suitable position in the imaging element. However, it is generally the outermost layer on either side of the film support. That is, if it is on the same side of the support as the light-sensitive layer or layers, it is further removed from the support than the most distant light-sensitive layer. If the protective layer is on the opposite side of the support than the light-sensitive layer, it is generally the layer furthest removed from the support. The protective layer has a thickness range of from 0.1 to 5 μm, preferably 0.2 to 3 μm. The protective layer may be applied over a UV absorbing layer, an antistatic layer and the like.

DESCRIPTION OF PREFERRED EMBODIMENTS

This invention contemplates a photographic element having a protective layer of lubricant particles in a binder having a mean volume equal or larger than $0.085\ \pi t^3$. For lubricant particles of spherical shape in the protective layer, the particle mean volume can be computed from its mean diameter. If the lubricant particle shape is irregular in the protective layer, the mean particle size can be measured in solutions or dispersions prior to coating by well-known particle size measurement techniques such as Coulter Multisizer, light scattering, microscopes, sedimentation techniques, and so on. The volume of the particles in the dry coating can then be computed from the mean particle size measured in the solutions or dispersions.

Lubricant particles with a volume less than $0.085\ \pi t^3$ or lubricants soluble in the protective layer can be used in combination with lubricant particles having a volume larger than $0.085\ \pi t^3$ for the practice of the present invention. However, in such circumstances, the fraction of the lubricant particles having a volume larger than $0.085\ \pi t^3$ should be used in a major amount.

The amount of lubricant particles coated in terms of the ratio by weight based on the amount of binder in the protective layer is preferably from 0.001 to 1, more preferably from 0.01 to 0.5, and most preferably from 0.05 to 0.1.

There is no limitation on the types of lubricants for the practice of the present invention. Typical lubricants include (1) silicone based materials disclosed, for example, in U.S. Pat. Nos. 3,489,567; 3,080,317; 3,042,522; 4,004,927; 4,047,958; and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,522; and 4,427,764, in British Patent Nos. 1,263,722; 1,198,387; 1,430,997; 1,466,304; 1,320,757; 1,320,565; and 1,320,756; and in German Patent Nos. 1,284,295; and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethylene), poly(trifluorochloroethylene), poly(vinylidene fluoride, poly(trifluorochloroethylene-co-vinyl chloride), poly(meth)acrylates or poly(meth)acrylamides containing perfluoroalkyl side groups, and the like. Lubricants useful in the present invention are also described in further detail in

*Research Disclosure,* No. 308, December 1989, page 1006, all of the above incorporated herein by reference.

The above lubricants also may contain reactive functional groups such as hydroxyl, thiol, carboxyl, carbodiimide, epoxy, aziridine, vinyl sulfone, sulfinic acid, active methylene, amino, and amide. Typical examples of compounds useful for the present invention are shown below, but the present invention is not limited by these compounds:

L-1. Carnauba Wax, Michelube 160 [Michelman Inc.]
L-2. Paraffin Wax 112/118 AMP, m.p.=46.1° C. [Frank B. Ross Inc. ]
L-3. Paraffin Wax 125/130 AMP, m.p.=53.3° C. [Frank B. Ross Inc.]
L-4. Paraffin Wax 140/145 AMP, m.p.=61.1° C. [Frank B. Ross Inc. ]
L-5. Ross Wax 140, m.p.=137.8° C. [Frank B. Ross Inc.]
L-6. Teflon 120, fluorinated ethylene propylene particles [E. I. du Pont de Nemours & Co.]
L-7. Teflon 30, poly(tetrafluoroethylene) particles [E. I. du Pont de Nemours & Co.]
L-8. Teflon 335, poly(tetrafluoroethylene-perfluoro(propyl vinyl ether)) particles [E. I. du Pont de Nemours & Co.]
L-9. GP-218 silicone polyol copolymer [Genesee Polymers Co.]
L-10. GP-4 silicone fluid, amine functionalized [Genesee Polymers Co.]
L-11. GP-7100 amine functional paintable silicone fluid [Genesee Polymers Co.]
L-12. GP-7200 silicone fluid, mercapto functionalized [Genesee Polymers Co.]
L-13. EXP-58 silicone wax [Genesee Polymers Co.]
L-14. EXP-61 silicone wax, amine functionalized [Genesee Polymers Co.]
L-15. EXP-77 silicone wax, mercapto functionalized [Genesee Polymers Co.]
L-16. GP-7101 silicone copolymer [Genesee Polymers Co.]
L-17. BYK-331, polyether modified di-methylpolysiloxane copolymer [BYK Chemie]
L-18. BYK-371, reactive silicone additive, an acrylic functional, polyester-modified dimethylpolysiloxane [BYK Chemie]
L-19. DC-200 silicone fluid [Dow Corning Inc.]
L-20. PS099 dimethylsiloxane-bisphenol A carbonate block copolymer [Petrarch Inc.]
L-21. PS130 polymethyloctadecylsiloxane [Petrarch Inc.]
L-22. PS135 poly(methylhexadecyl siloxane) [Petrarch Inc.]
L-23. PS-464 polydimethylsiloxane, vinylphenylmethyl terminated [Petrarch Inc.]
L-24. Sorbitan monostearate
L-25. Ethylene glycol distearate
L-26. Ethylene glycol monostearate
L-27. Potassium hexadecyl phosphate
L-28. Sodium hexdecanesulfonate
L-29. Lubracal 60, Calcium stearate
L-30. Sodium stearate
L-31. Lithium stearate
L-32. Glyceryl monostearate Lubricant particles can be prepared by various well-known techniques, for example, by spray drying the particles from a solution of lubricant in a suitable solvent; by direct dispersion of a lubricant (which is in its liquid form at the dispersion temperature) in a medium where the lubricant is insoluble; by evaporation dispersion process where a solution of lubricant in an auxiliary solvent is dispersed in a medium in which both the lubricant and solvent are insoluble and the auxiliary solvent is then evaporated from the dispersion; by pulverizing and classification of solid lubricant particles; by emulsion, or suspension, or dispersion polymerization suitable monomers whose polymer particles have lubricating effect (e.g. Teflon™ particles), and by limited coalescence technique where a lubricant or a lubricant solution is added to a medium containing a particulate stabilizing agent and the mixture is then subjected to shearing forces by agitation, homogenization and the like to reduce the particle size. After shearing is stopped an equilibrium is reached with respect to the size of the droplets as a result of the particulate stabilizer in coating the surface of the droplet as described in copending application Serial No., Docket No. 71507RAG, entitled "Lubricant Particles, Method of Preparation, and Photographic Elements" by T. Whitesides, B. L. Howell, and R. E. Factor, filed on even date herewith and commonly assigned with this application (herein incorporated by reference).

Various dispersing aids can be used in making lubricant particle dispersions in an appropriate liquid medium. If the liquid medium is water, dispersing aids include, for example, various types of surfactants (nonionic, anionic, cationic, amphoteric, and polymeric), various water soluble polymers, various aqueous polymer dispersions and colloidal polymer particles, block copolymers and block copolymer micelles, and various inorganic colloidal oxide particles. If the liquid medium is an organic solvent, the dispersing aids include various solvent soluble or dispersible materials. In the above dispersion, a co-dispersing agent can also be used in combination with the dispersing aid to achieve optimum results.

It is desirable in the present invention that the lubricant particles interact strongly with the binder in the final dry coating to prevent, for example, fall-off of lubricant particles in processing solution, and to further enhance the cohesion/adhesion strength of the protective layer. Possible approaches include, for example, the use of lubricants with reactive functional groups and the use of a dispersing aid which can interact strongly with both lubricant particle and the binder.

Any suitable binder can be used in practice of the present invention including hydrophilic colloids, such as gelatin, as well as hydrophobic polymer resin binders. While the actual amount of binder coated in order to achieve desirable surface physical properties will vary depending on the size of the lubricant particles, the binder is preferably coated at a coverage greater than 0.1 $g/m^2$ to provide effective adhesion of the particles to the surface of the element.

Suitable hydrophilic binders include both naturally occurring substances such as proteins, protein derivatives, cellulose derivatives (e.g. cellulose esters), gelatins and gelatin derivatives, polysaccaharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like.

Useful resin binders include polyurethane (e.g. Neorez R960 sold by ICI), cellulose acetates (e.g. cellulose diacetate, cellulose acetate butyrate, cellulose acetate propionate), poly(methyl methacrylate), polyesters (e.g. Vitel R sold by Goodyear Tire & Rubber Co.), polyamides (e.g. Unirez sold by Union Camp, Vesamide sold by General Electric Co.), polycarbonates (e.g. Makrolon sold by Mobay Chemical Co., Lexan sold by General Electric Co.), polyvinyl acetate, and the like.

The binder should be chosen so that it effectively adheres the lubricant particles to the surface of the element at the binder level. For cross-linkable binders such as gelatin and polyurethanes, the binder is preferably cross-linked so as to provide a high degree of cohesion and adhesion. Cross-linking agents or hardeners which may effectively be used in the coating compositions of the present invention include aldehydes, epoxy compounds, polyfunctional aziridines, vinyl sulfones, methoxyalkyl melamines, triazines, polyisocyanates, dioxane derivatives such as dihydroxydioxane, carbodiimides, chrome alum, zirconium sulfate, and the like.

The protective layer useful in the practice of the invention may optionally contain surface active agents, antistat agents, charge control agents, thickeners, ultraviolet ray absorbers, processing removable dyes, high boiling point solvents, silver halide, colloidal inorganic particles, magnetic recording particles, matting agents, polymer latexes, various other additives and the like.

The protective layer useful in the practice of the invention can be applied in any of a number of well-known techniques, such as dip coating, rod coating, blade coating, air knife coating, gravure coating and reverse roll coating, extrusion coating, slide coating, curtain coating, and the like. The lubricant particles and the binder are preferably mixed together in a liquid medium to form a coating composition. The liquid medium may be a medium such as water or other aqueous solutions in which the hydrophilic colloid are dispersed with or without the presence of surfactants, or it may be a solvent such as an organic solvent in which the resin binder (but not the lubricant particles of the present invention) is dissolved. After coating, the protective layer is generally dried by simple evaporation, which may be accelerated by known techniques such as convention heating. Known coating and drying methods are described in further detail in *Research Disclosure,* No. 308, December 1989, pages 1007 to 1008.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic material is exposed in a similar manner as any photographic materials are exposed in cameras, and then the product is sent to the developer who removes the photographic material and develops it. Return of the product to the consumer does not normally occur.

Single use cameras and their methods of manufacture and use are described in U.S. Pat. Nos. 4,801,957; 4,901,097; 4,866,459; 4,849,325; 4,751,536; 4,827,298; European Patent Applications 0 460 400; 0 533 785; 0 537 908; and 0 578 225, all of which are incorporated herein by reference.

The invention is illustrated by the following examples; the types and sizes of lubricant particles used in the examples are listed in Table 1:

TABLE 1

| Particle | Lubricant | Stabilizer | Particle Size (μm) | Mean volume ($\mu m^3$) |
|---|---|---|---|---|
| P-1 | L-3 | Sodium Dodecyl Sulfate (SDS)/Tergitol (Union Carbide) | 0.19 | 0.0036 |
| P-2 | L-4 | SDS/Tergitol | 0.22 | 0.0056 |
| P-3 | L-11 | SDS/Tergitol | 0.19 | 0.0035 |
| P-4 | L-12 | SDS/Tergitol | 0.21 | 0.0046 |
| P-5 | L-13 | SDS/Tergitol | 0.14 | 0.0015 |
| P-6 | L-15 | SDS/Tergitol | 0.16 | 0.002 |
| P-7 | L-19 | SDS/Tergitol | 0.30 | 0.013 |
| P-8 | L-3 | SDS | 1.39 | 1.41 |
| P-9 | L-4 | SDS | 1.38 | 1.38 |
| P-10 | L-11 | SDS | 2.06 | 4.58 |
| P-11 | L-12 | SDS | 1.78 | 2.95 |
| P-12 | L-13 | SDS | 1.56 | 1.99 |
| P-13 | L-15 | SDS | 1.54 | 1.9 |
| P-14 | L-19 | Alkanol XC/ Ludox ™* | 1.00 | 0.52 |
| P-15 | L-19 | Alkanol XC/ Ludox ™ | 2.50 | 8.18 |
| P-16 | L-19 | Alkanol XC/ Ludox ™ | 4.50 | 47.69 |
| P-17 | L-19 | Alkanol XC/ Ludox ™ | 7.50 | 220.78 |

*Ludox ™ (E. I. du Pont de Nemours Co.) are colloidal silica particles having a particle size of about 22 nm.

EXAMPLE 1 TO 5 AND COMPARATIVE SAMPLE A TO H

A series of photographic elements are prepared as follows: A cellulose triacetate film support having an antihalation layer on one side and an antistatic backing layer on the other side (as described below) is coated on the antihalation layer with the following image forming layers in sequence (Example 2 of U.S. Pat. No. 5,288,598): a slow cyan dye-forming layer, a fast cyan dye-forming layer, an interlayer, a slow magenta dye-forming layer, a fast magenta dye-forming layer, an interlayer, a slow yellow dye-forming layer, a fast yellow dye-forming layer, and a UV layer. A protective layer containing gelatin binder is coated on the top of the UV layer and has a composition listed in Table 2. The protective layer has a dry thickness of about 1 μm. Thus, the mean volume of the lubricant particles must be at least $0.085\pi$ ($1^3$) or 0.27 $\mu m^3$ to be in accordance with this invention.

TABLE 2

| Composition of the Protective Layer | |
|---|---|
| a. Gelatin, Type IV | 888 $mg/m^2$ |
| b. Lubricant Particles | Table 3 |
| C. Fluorad FC-134 | 3.9 $mg/m^2$ |
| d. Aerosol TO | 21.5 $mg/m^2$ |
| e. Surfactant Olin 10G | 27.2 $mg/m^2$ |
| f. Poly(vinyl toluene-co-divinyl benzene) 80:20 ratio, 1.5 μm | 107 $mg/m^2$ |

The scratch resistance of the protective overcoat was evaluated in the following way: Discs of processed film were placed on a Taber Abrader and abraded according to ASTM method D1044. The abraded disc is then cut to a 35 mm negative size and printed onto photographic paper using the diffusion of an Eastman Kodak 3510A Printer. The prints were processed and visually examined for the level of scratch marks. The following scale was used in ranking the scratch resistance of the film protective layer: 0—zero quantity of scratches, 1—very few scratches, 3—moderate amount of scratches, and 5—many scratches. The results are listed in Table 3.

TABLE 3

| Coating Lubricant | Particle | Coverage mg/m$^2$ | Particle Volume μm$^3$ | Printable Scratch Rating |
|---|---|---|---|---|
| Sample A | P-1 | 39.1 | 0.0036 | 5 |
| Sample B | P-2 | 39.1 | 0.0056 | 5 |
| Sample C | P-3 | 39.1 | 0.0035 | 5 |
| Sample D | P-4 | 39.1 | 0.0046 | 5 |
| Sample E | P-5 | 39.1 | 0.0015 | 5 |
| Sample F | P-6 | 39.1 | 0.002 | 5 |
| Sample G | P-7 | 39.1 | 0.013 | 3 |
| Sample H | None | | | 3 |
| Example 1 | P-14 | 39.1 | 0.52 | 0 |
| Example 2 | P-15 | 39.1 | 8.18 | 0 |
| Example 3 | P-16 | 39.1 | 47.69 | 0 |
| Example 4 | P-17 | 39.1 | 220.78 | 0 |
| Example 5 | P-10 | 39.1 | 4.58 | 1 |

As can be seen from Table 3, the use in the protective layer of lubricant particles having a volume larger than 0.085 $\pi t^3$ leads to a significant reduction in the amount of printable scratches.

EXAMPLE 6 TO 11 AND COMPARATIVE SAMPLE I TO K

The photographic elements in these examples and comparative samples were prepared as described in Examples 1–5 and A–H above except without matte particles in the protective layer. The presence of matte particles in the protective layer increases the surface roughness and therefore surface haze. The elimination of matte from the protective layer yields a true measure of its abrasion resistance by ASTM method D1044.

To evaluate the abrasion resistance of the protective overcoat, discs of coating were placed on a Taber Abrader and abraded in accordance with ASTM method D1044. Amount of the transmitted light was measured on the abraded area. The difference in percentage light transmission or difference in measured percentage haze (Delta Haze) before and after Taber abrasion was used to measure the abrasion resistance of the coatings. The results are listed in Table 4.

TABLE 4

| Coating | Lubricant Particle | Coverage mg/m$^2$ | Particle Volume/ 0.085$\pi t^3$ | Taber Abrasion (% Delta Haze) |
|---|---|---|---|---|
| Sample I | None | | | 14.2 |
| Sample J | P-7 | 39.1 | 0.05 | 11.2 |
| Sample K | P-7 | 78.2 | 0.05 | 10.8 |
| Example 6 | P-17 | 39.1 | 827.0 | 10.2 |
| Example 7 | P-10 | 39.1 | 17.4 | 8.6 |
| Example 8 | P-8 | 39.1 | 5.3 | 8.2 |
| Example 9 | P-9 | 39.1 | 5.2 | 8.6 |
| Example 10 | P-12 | 39.1 | 7.4 | 3.2 |
| Example 11 | P-13 | 39.1 | 7.2 | 5.0 |

The results that are compiled in the foregoing Table have clearly demonstrated that the samples according to the present invention provide superior abrasion resistance compared to samples containing lubricant particles of volume less than 0.085 $\pi t^3$.

The photographic processing steps to which the raw film may be subject may include, but are not limited to the following:

1.) color developing→bleach-fixing→washing/stabilizing;

2.) color developing→bleaching→fixing→washing/stabilizing;

3.) color developing→bleaching→bleach-fixing→washing/stabilizing;

4.) color developing→stopping→washing→bleaching→washing→fixing→washing/stabilizing;

5.) color developing→bleach-fixing→fixing→washing/stabilizing;

6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

What is claimed is:

1. An imaging element having a support, at least one light-sensitive layer and a protective layer containing a binder and lubricating particles, said lubricating particles having a volume of at least 0.085 $\pi t^3$ where t is the dry thickness of the protective layer.

2. The imaging element of claim 1 wherein the dry thickness of the protective layer varies from 0.1 to 5 μm.

3. The imaging element of claim 1 wherein the protective layer is on the same side of the support as the light-sensitive layer and further removed from the support than the light-sensitive layer.

4. The imaging element of claim 1 wherein the protective layer is on the outermost layer on the opposite side of the support having a light-sensitive layer.

5. The imaging element of claim 1 wherein the light-sensitive layer contains silver halide particles.

6. The imaging element of claim 1 wherein the protective layer contains a matting agent.

7. The imaging element of claim 1 wherein the lubricating particles comprise a fluorine containing polymer.

8. The imaging element of claim 7 wherein the fluorine containing polymer is polytetrafluoroethylene.

9. The imaging element of claim 1 wherein the lubricating particles comprise an organo-polysiloxane.

10. The imaging element of claim 9 wherein the organo-polysiloxane is polydimethylsiloxane.

11. The imaging element of claim 1 wherein the binder is hydrophilic.

12. The imaging element of claim 11 wherein the binder is gelatin.

13. The imaging element of claim 1 wherein the binder is hydrophobic.

14. The imaging element of claim 13 wherein the binder is a polymer.

15. The imaging element of claim 14 wherein the polymer is urethane, ester, carbonate, or acrylic.

16. The imaging element of claim 1 contained within a single use camera.

* * * * *